US005137333A

United States Patent [19]

Chee

[11] Patent Number: 5,137,333

[45] Date of Patent: Aug. 11, 1992

[54] SEAT CUSHION

[75] Inventor: Edward K. Chee, San Francisco, Calif.

[73] Assignee: Rolliture Corporation, San Francisco, Calif.

[21] Appl. No.: 525,955

[22] Filed: May 21, 1990

Related U.S. Application Data

[63] Continuation-in-part of Ser. No. 470,149, Jan. 25, 1990, abandoned.

[51] Int. Cl.[5] ..... A47C 7/02

[52] U.S. Cl. ..... 297/458; 5/652

[58] Field of Search ..... 297/458, 459, 452, 289, 297/258, 272; 5/481, 464, 440, 437

[56] References Cited

U.S. PATENT DOCUMENTS

| | | | |
|---|---|---|---|
| 3,070,402 | 12/1962 | Stanton | 5/464 X |
| 4,183,494 | 1/1980 | Cleveland | 297/264 X |
| 4,514,010 | 4/1985 | Sabater Gonzalez | 297/DIG. 3 X |
| 4,522,447 | 6/1985 | Snyder et al. | 297/452 |
| 4,722,550 | 2/1988 | Imaoka et al. | 297/DIG. 3 X |
| 4,789,202 | 12/1988 | Alter | 297/284 |
| 4,819,288 | 4/1989 | Lowthian | 297/458 X |
| 4,856,844 | 8/1989 | Isono | 297/458 X |
| 4,889,387 | 12/1989 | Gregory | 297/458 |
| 4,947,500 | 8/1990 | Seiler | 5/464 X |
| 4,951,336 | 8/1990 | Silverman | 5/464 X |
| 4,965,899 | 10/1990 | Sekido et al. | 297/284 X |

FOREIGN PATENT DOCUMENTS

| | | | |
|---|---|---|---|
| 3412396 | 10/1985 | Fed. Rep. of Germany | 297/452 |
| 654561 | 6/1963 | Italy | 5/481 |
| 12663 | 9/1912 | United Kingdom | 5/437 |
| 2016918 | 9/1979 | United Kingdom | 5/464 |

*Primary Examiner*—Jose V. Chen

[57] ABSTRACT

A seat cushion includes a rigid base and at least one internal rear wedge disposed on or formed on the upper surface of the base and having a first upper face that slants downward toward the front of the base. It also includes at least one internal front wedge formed on the upper surface of the base and having a second upper face that slants downward toward the rear of the base. It further includes an external cushion, the internal wedges and base being fixed within the external cushion. The cushion has a rocker on the lower surface of the base to allow its angle of tilt to be adjusted by the user.

13 Claims, 6 Drawing Sheets

SEAT CUSHION

This application is a continuation-in-part of my copending application Ser. No. 07/470,149, filed Jan. 25, 1990, and entitled "SEAT CUSHION", now abandoned.

BACKGROUND OF THE INVENTION

1. Field of the Invention

This invention relates to seat cushions, more particularly to a seat cushion that improves seating posture by applying torque to the ischial tuberosities of the pelvic bones and the gluteal muscles of a user.

2. Brief Description of the Prior Art

It is estimated that almost half of the population of the industrialized world is suffering from back disorders of various forms. Vast sums are spent on medical treatment, disability pay, rehabilitation and the like related to these problems. Treatment often does not begin, however, until a cure is not possible. Studies indicate that sitting causes greater strain on the lower spine than standing or bending and that higher levels of degeneration of the bones, discs, musoles, and ligaments of the lower back have been found in sedentary workers than in those handling heavy materials. For this reason, a great deal of effort has been directed toward developing ergometric seating apparatus that prevents back pain and injury through the promotion of good seating posture.

It is known that sitting reduces the normal lumber curve (extension, lordosis). Prolonged exposure to this posture can produce low back pains and even disc degeneration. A. C. Mandal, in the March, 1981, issue of Applied Ergonomics, suggests that a forward angle tilt of 20 degrees in the seat pan will maintain lordosis.

In the past, when most workers spent most of the working day standing or lifting, flat chairs were appropriate to help relieve symptoms of hyper extension of the lumber curve (swayback). With modern workers spending most of their time sitting, hypolordic posture is of more concern. The common flat seated chair in the modern workplace is implicated in the creation of back pain by stretching the posterior longitudinal ligaments, and may even distort the intervertebral discs. Modern day workers, then, need seats which will, as Mandal suggests, slant forward to help maintain the lordic curve.

Modern orthopedic chairs, costing $400 or more, are available which allow a certain degree of forward tilt. The primary disadvantage of a seat having sufficient forward slant to solve the postural problem is that the sitter tends to slide down and off. This causes the sitter to tense up, which negates any posture benefits, because of the discomfort and attention required to maintain one's position. An attempt to correct this resulted in the kneeling or Balans chair, which utilizes a pad upon which the knees rest. The pressure from the pad on the knees prevents the sitter from sliding forward due to the forward tilt of the seat. One disadvantage of this chair is that prolonged sitting in it becomes uncomfortable for the knees. Also, it is cumbersome to get in and out of.

Perhaps the most common solution at this time is the lumbar support cushion, which applies pressure to the apex of the lumbar curve to help maintain it. Its primary disadvantage is that the sitter needs to be sitting back at an angle great enough to apply pressure on the spine for such a cushion to be effective. This is an uncommon situation in the workplace. Also, any pressure on the spine may inhibit the cranio-sacral rhythm, and therefore, the circulation of cerebrospinal fluid.

Prior developments in this field may be generally illustrated by reference to the following patents:

| U.S. Pat. No. | Patentee | Issue Date |
|---|---|---|
| 4,218,792 | H. Kogan | Aug. 26, 1980 |
| 1,716,871 | E. Weldon | June 11, 1929 |
| 3,503,649 | M. Johnson | Mar. 31, 1970 |
| 3,376,070 | M. Johnson | Apr. 02, 1968 |
| 2,855,986 | B. Engelen, Sr. | Oct. 14, 1958 |
| 3,394,414 | L. Unger | July 30, 1968 |
| 3,846,857 | C. Weinstock | Nov. 12, 1974 |
| 2,412,112 | G. Wood et al. | Dec. 03, 1946 |
| 2.156,629 | M. Hutchinson | May 02, 1939 |

SUMMARY OF THE INVENTION

The present invention is a seat cushion which tilts forward, yet stabilizes the pelvis, so that there is no forward slide. It uses internal high density foam wedges or inflatable wedges to apply a force on the anterior of the ischial tuberosities and the posterior inferior iliac spine to rotate the pelvis forward and the lumbar curve into extension. It has an external soft foam cushion or inflatable cushion which is generally shaped like a forwardly angled wedge, but which has an upwardly protruding lip, which lip also catches the anterior aspect of the ischial tuberosities to prevent the forward slide. However, unlike the internal wedges, which do not significantly deform, the outer (soft foam) cushion deforms under the pressure of the sitter's weight, thereby molding to his or her body contours, for comfort and the maintenance of circulation. This results in a strong forward tilting action and, yet, maintains a high level of comfort.

A lower roller or rocker allows a wide range of postural angles to be selected and varied by the user, according to individual preference and the need to provide rest and circulation to areas of highest pressure.

The seat cushion of this invention is thus designed to absorb most of the body's weight naturally through the ischial tuberosities. It has been noted by others that one half of the body weight is supported by the 8 per cent of the seat area that is under the ischiae. Much of the comfort of the cushion is derived from its ability to maintain a neutral posture without muscular support.

Features and Advantages

An object of this invention is to provide a seat cushion which holds the pelvic area of the user at an angle which is most conducive to the maintenance of proper lordosis of the spine. Accordingly, the seat cushion of this invention includes a rigid base and at least one internal high-density hard foam or inflatable rear wedge on the rear upper surface of the base, the rear wedge having a first upper face that slants downward toward the front of the base. It also includes at least one internal high-density hard foam or inflatable front wedge on the front upper surface of the base, the front wedge having a second upper face that slants downward toward the rear of the base. It further includes an external low-density soft foam or inflatable cushion, the internal wedges being mounted on the base within the external cushion.

In a preferred embodiment, the cushion has two internal rear wedges and two internal front wedges, one internal rear wedge and one internal front wedge on each side of a centerline that bisects the base into right and left portions.

Yet another feature is a third upper face on the external cushion that slants downward toward the front portion of the base and which terminates in an upwardly protruding lip.

Another feature of the cushion is a rocker on the lower surface of the base which allows the angle of tilt of the base to be adjusted by the user. A semi-cylindrical segment of a tube which is mounted perpendicular to the centerline of the base constitutes the preferred rocking means.

In order to maintain comfort and circulation, there is a first recess in the third face and a second recess in the lip. Furthermore, each of the two internal rear wedges and each of the two internal front wedges is offset from the other, forming two gaps along the centerline of the base, which recesses and gaps are adapted to relieve pressure against sensitive body parts of the user.

Still another feature is the use of one or more inflatable fluid-filled wedges or cushioning components in place of corresponding foam components used in the first described embodiment.

Yet another feature is hook and loop fastener material (commonly sold under the trademark VELCRO) which may be used to secure the internal wedges to the upper surface of the base and may secure the semi-cylindrical tube segment to the lower surface of the base.

Other features of the invention provide an apparatus which is easy to use, attractive in appearance and suitable for mass production at relatively low cost.

Other novel features which are characteristic of the invention, as to organization and method of operation, together with further objects and advantages thereof will be better understood from the following description considered in connection with the accompanying drawing in which preferred embodiments of the invention are illustrated by way of example. It is to be expressly understood, however, that the drawing is for the purpose of illustration and description only and is not intended as a definition of the limits of the invention.

Certain terminology and derivations thereof may be used in the following description for convenience in reference only and will not be limiting. For example, the words "upwardly," "downwardly," will refer to directions in the drawings to which reference is made. The words "inwardly" and "outwardly" will refer to directions toward and away from, respectively, the geometric center of a device and designated parts thereof. It is to be noted, however, that the words "leftwardly," and "rightwardly" are taken with reference to the view of the cushion obtained from behind the device, in order to match sides of the cushion with the normal right and left orientation of the body parts of a seated user.

IN THE DRAWING

FIG. 1 is an exploded perspective view of a preferred cushion of this invention;

FIG. 2 sectional elevation of the cushion of FIG. 1, taken along line 2—2 of FIG. 1;

Drawing Reference Numerals

Figure 1:
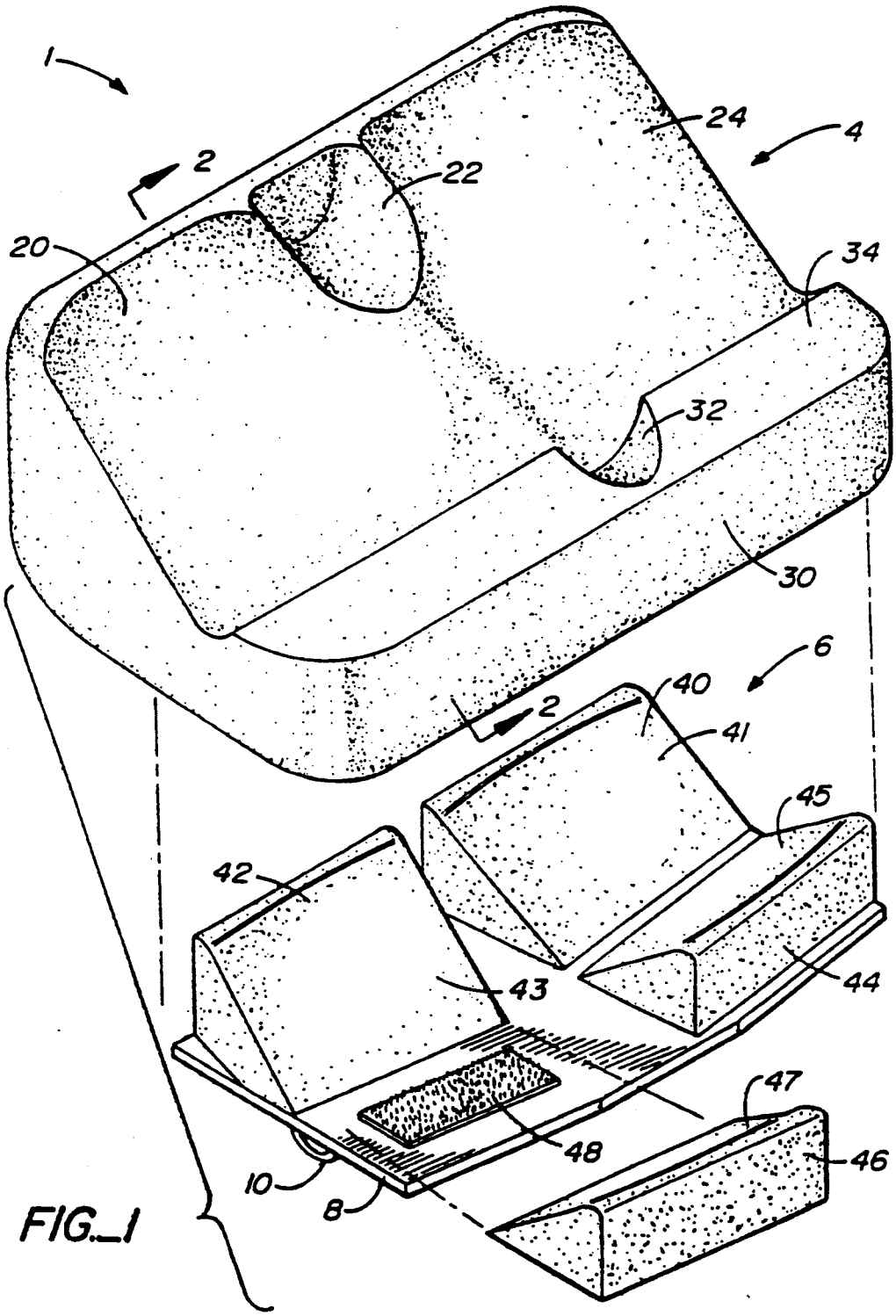

1 seat cushion
4 external soft foam cushion
6 internal hard foam wedge assembly
8 base
10 rocker
11 hook and loop fastener
12 internal cavity of 4
20 rear outer wedge
22 recess in 20
24 upper face of 20
30 forward outer lip
32 recess in 30
34 upper face of 30
40 left internal rear wedge
41 upper face of 40
42 right internal rear wedge
43 upper face of 42
44 left internal forward wedge
45 upper face of 44
46 right internal forward wedge
47 upper face of 46
48 hook and loop fastener
50 user
52 pelvic area of 50
54 hips
56 ischial tuberosities
58 coccyx
60 sacrum
62 lumber vertebrae
64 femur
101 seat cushion
104 external soft foam cushion
108 base
110 rocker
120 rear outer wedge
122 recess in 120
124 upper face of 120
130 forward outer lip
132 recess in 130
134 upper face of 130
140 left internal rear wedge
144 left internal forward wedge
201 seat cushion
204 external soft foam cushion
210 axle
242 right internal rear wedge
246 right internal forward wedge
251 brackets
250 user
252 chair
260 air cushion
262 base
264 slide valve
266 storage compartment
268 supply tube
270 squeeze bulb
271 valve
272 pressure line
274 pressure line
276 pressure line 278 container
280 container
282 container
284 velcro fastener
286 velcro fastener
288 velcro fastener
290 velcro fastener

DETAILED DESCRIPTION OF A PREFERRED EMBODIMENT

Figure 2:
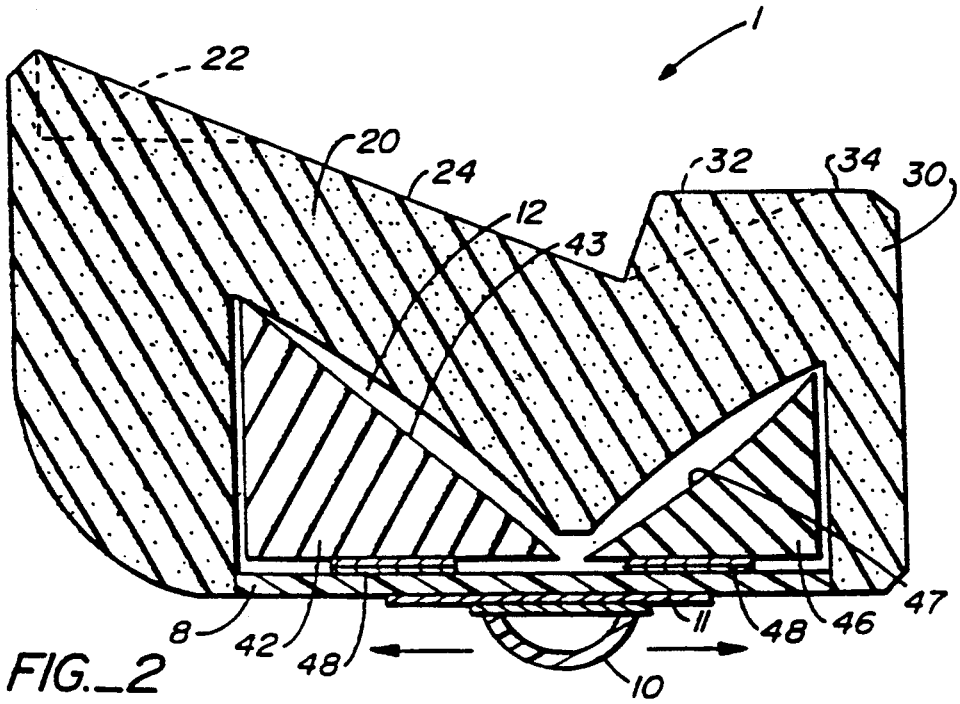

Referring to FIGS. 1 and 2, there is illustrated therein a seat cushion 1 of this invention. Cushion 1 generally comprises an external soft foam cushion 4 and an internal hard (high density) foam wedge assembly 6, both of which are mounted 6 on the upper surface of a rigid planar base 8. An outwardly convex rocking mechanism 10 is mounted on the lower surface of the base. The rocking mechanism preferably comprises an arcuate or semi-cylindrical segment of a tube that traverses the width of the base perpendicular to a centerline which divides the base into right and left portions. However, the rocker could be a pair of elongate parallel curved legs like those used on rocking chairs. In the case where a cushion of this invention is permanently incorporated into a chair (see FIG. 6), so as to replace the regular seat cushion, the rocking mechanism comprises an axle 210 that rotates about a fixed pivot point or points, or the like. (It is to be noted that, for convenience, the last two positions of the reference numerals of alternate embodiments of the invention duplicate those of the reference numerals of the embodiment of FIG. 1 where they refer to corresponding or equivalent parts.)

Figure 4:
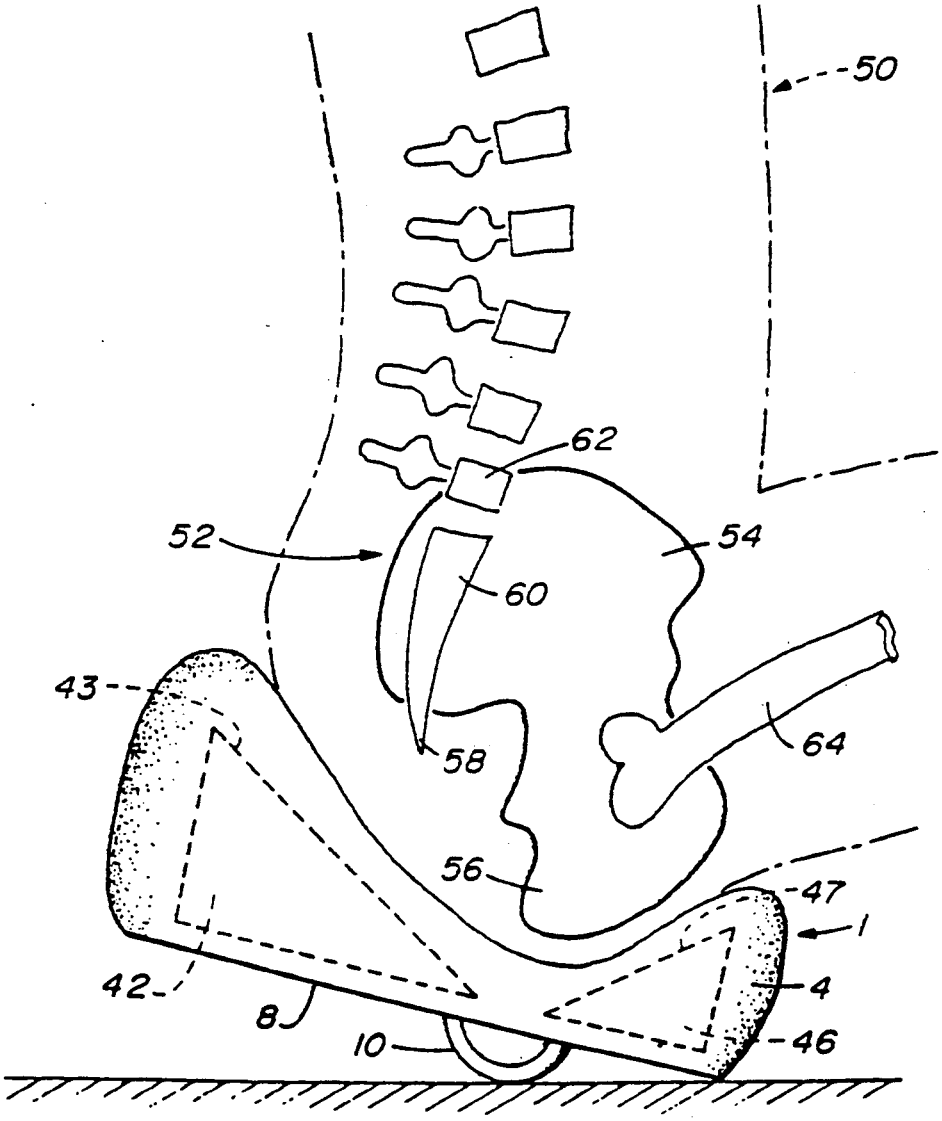
FIG. 4 is a diagrammatic side elevation of the device of FIG. 1, showing it being used in a rocked forward position.
Figure 5:
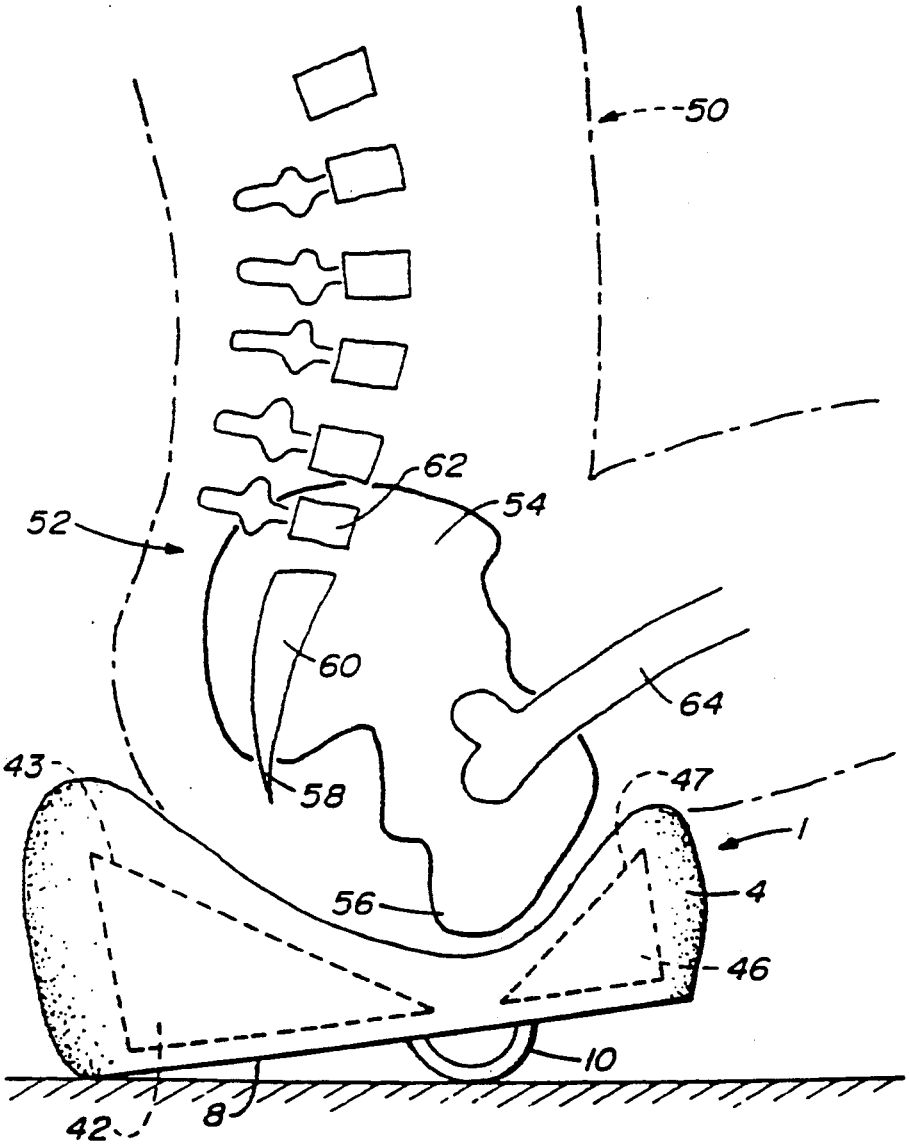
FIG. 5 is a diagrammatic side elevation showing the device of FIGS. 1 and 4 in a rocked back position.

The external soft foam cushion is highly deformable under pressure, but is resilient, i.e. it returns to its original shape after use. It has a large rear outer wedge 20 that has its upper face 24 canted or bevelled downward toward the front of the device. Face 24 is generally planar, although it may have small inwardly concave recesses on its right and left sides (looking from the rear of the device) adapted to comfortably receive the right and left buttocks of a user. A recess 22 of suitable shape may be molded into the outer wedge 20 at its rear center and is used to relieve pressure on the user's coccyx 58 and sacrum 60 (FIGS. 4 and 5).

The outer rear wedge terminates at the front of the cushion 1 in an upwardly protruding forward lip 30. In a preferred embodiment, this lip has a generally horizontal upper face 34. A recess 32 of suitable shape may be molded into the outer lip 30 at its rear center and is used to relieve pressure on the user's genital region.

Figure 3:
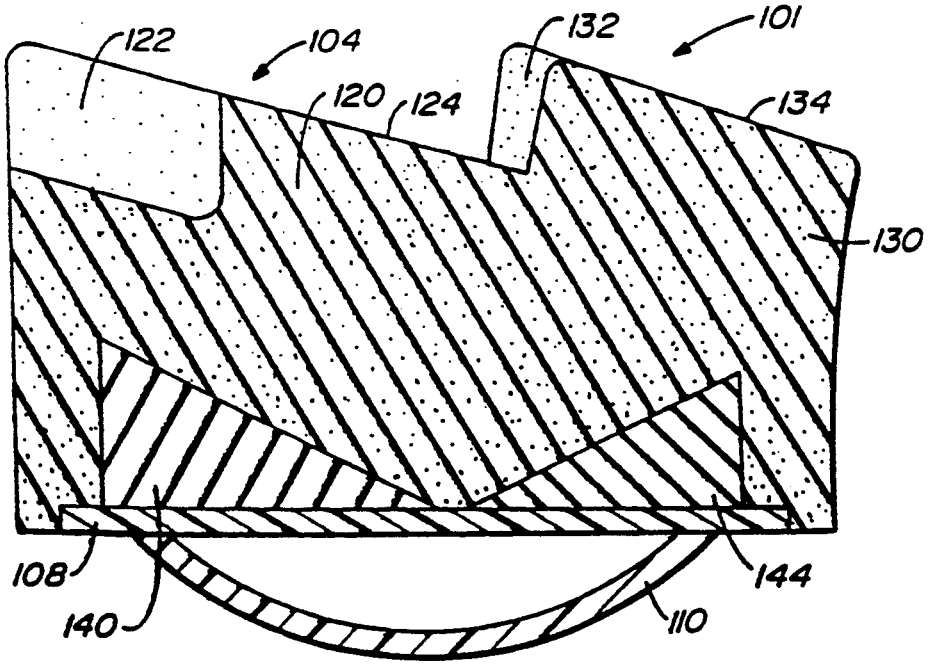
FIG. 3 is a sectional elevation of another embodiment, taken along the line of the cushion.

There is considerable latitude for varying the shape of the parts of the external soft foam cushion, insofar as, in any event, it is significantly compressed and molded by the weight 16 of the user during use. For example, the upper lip face can be slightly bevelled forwardly as is the upper lip face 134 of the alternate embodiment 101 that is illustrated in FIG. 3. The corners and edges of the external cushion may be attractively rounded, as shown. While the external soft foam cushion will generally be characterized by a forwardly facing rear wedge terminating in an upwardly protruding forward lip, one could conceive of an external cushion that has, for example, a flat upper face, without departing from the scope of this invention, because the internal hard foam wedge assembly 6 provides all or nearly all of the posture correcting support.

The wedge assembly 6 preferably comprises four hard wedges fabricated of a high-density plastic foam which is non-resilient (although some slight deformation under pressure is allowable for maintenance of the user's comfort and circulation). Mounted at the rear of the base 8 are two large internal hard foam wedges: left 40 and right 42 (viewed from the rear). While these are preferably made of high-density foamed polymer plastic, they could be made of any high-density, substantially non-deforming, material. For example, they could be made of the same rigid plastic as the base, and could even be molded with the base as a one-piece unit. These wedges have their upper faces (41 and 43, respectively) canted or bevelled downwardly toward the front of the cushion 1. Mounted at the front of the base 8 are two smaller internal hard foam wedges: left 44 and right 46. These have their upper faces (45 and 47, 16 respectively) bevelled downwardly toward the rear of the cushion 1. Typically, the apexes of the rear wedges 40,42 will be vertically higher than the apexes of the front wedges 44,46 (i.e. the front wedges are smaller in order to aid in tilting the pelvis).

The wedge pairs 40,42 and 44,46 are mounted on the base with gaps along the base's centerline between the individual wedges of each pair, in order to relieve pressure on the coccyx and genitals, respectively. However, it is to be noted that each wedge pair could be replaced with a single continuous transverse wedge having a suitable recess, in the manner of the rear outer wedge 20 and the forward outer lip 30.

The internal hard foam wedges may be made removable through the use of suitable attachment means, such as VELCRO brand (or other brand) hook and loop fastener material 48. This would allow the user to remove the external soft foam cushion 4 and alter the internal wedges' size, density, angle of bevel, and the like, according to individual preference.

Turning to FIG. 2, it can be seen that internal hard foam wedges of the removable type may be contained in an internal cavity 12 which is molded into the lower surface of the external wedge 4 and shaped large enough to accommodate internal wedges of varying sizes and shapes.

The rocker 10 may also be affixed to the base by VELCRO hook and loop material 11 in order to make adjustable its position relative to the front and rear of the cushion 1. As 16 will be made clearer from the discussion below, this fulcrum adjustment will vary the maximum angle of base tilt that the user may develop before the leading edge of the base contacts the chair support surface.

FIG. 3 illustrates an alternate embodiment of the invention. Cushion 101 generally comprises an external soft foam cushion 104 and an internal hard (high density) foam wedge assembly, two of which internal wedges are shown in the centerline cross-section of FIG. 3, namely, rear left 140 and front left 144. The external cushion and the internal wedges are mounted on the upper surface of a rigid planar base 108. A large outwardly-convex rocker 110 is mounted on the lower surface of the base.

The external soft foam cushion 104 has a large rear outer wedge 120 that has its upper face 124 bevelled downward toward the front of the device. A recess 122 of suitable shape is 6 molded into the outer wedge 120 at its rear center and is used to relieve pressure on the user's coccyx and sacrum.

The outer rear wedge terminates at the front of the cushion 101 in an upwardly protruding forward lip 130. In this embodiment, the lip has an upper face 134 which is sloped downward slightly in the forward direction. A recess 132 of suitable shape is molded into the outer lip 130 at its rear center.

The left internal hard foam wedges 140,144 (and the right wedges, the latter of which are not illustrated) of this 16 embodiment are not removable. Instead, they are permanently affixed to the base 108. During manufacture, the base and hard wedges are assembled first, whereupon the external soft foam cushion may be molded in place directly on top of the hard internal wedges. This eliminates the need to separately mold an internal wedge-retaining cavity into the external cushion of this embodiment of the invention. If the base and internal wedges are molded together of one piece, the wedges might be better described as being "of" the upper surface of the base than "on" it. However, the two terms will be used interchangeably herein so as not to be limiting.

The use and operation of the posture improving and/or correcting seat cushion 1 will be understood by reference to FIGS. 4 and 5. A user 50 places the cushion on the upper surface of a normal chair or bench, sits on top of the cushion, and rotates it forward about the rocker 10 to a comfortable and 6 beneficial angle, as illustrated in FIG. 4. The user thereby assumes an upright posture which imparts the proper lordosis (curve) to the lumbar vertebrae 62, as explained below.

The user's pelvic area 52 is shown schematically as follows. The coccyx 58 is positioned within the recess 22 of the external cushion 4. It meets no significant resistance or pressure from the rear wedges 40,42 when the external cushion is deformed from the user's weight, due to the space left between the wedges as they are mounted on the base 8. The bulk of the user's weight is supported through the buttocks by the ischial tuberosities 56, the latter of which rest against the upper faces 45,47 of the high-density forward internal wedges 44,46. The external low-density foam cushion is substantially entirely deformed (compressed) in this region. Of course, some weight is supported elsewhere, for example, by other regions of the pelvis (through, e.g., pressure of the buttocks against rear internal wedges 40,42) by the femurs 64 (through the thighs) and by the spine (through side thrust from the chair back).

The angle of the hips 54 with respect to true vertical is determined by the position of the ischial tuberosities 56 on these wedges. This in turn determines, as the user adjusts his or her back to a comfortable uperight position,the angle ofthe sacrum 60 with respect to true vertical and with respect to the hips.

As previously mentioned, it is desired to impart with tis invention a forward tilt to the pelvic area 52 without causing muscle tension in the user 50 as he or she attempts to keep from sliding forward. Forward angling of the base 8 through the rocker 10, while the ischial tuberosities 56 are firmly held in place betweeen the two pairs of internal wedges 40,42 and 44,46, accomplishes this objective.

When the user 50 desires a temporary rest from the most beneficial forwardly-tilted position shown in FIG. 4, the cushion can be rocked back to the position shown in FIG. 5. Of course, many intermediate positions are possible between these extremes, depending on personal preference. While the angle of tilt of the base is certainly not as favorable in the position shown in FIG. 5, it is to be noted that the pelvis, including ischial tuberosities, does not change its position with respect to the cushion from the base angle of FIG. 4 to that of FIG. 5, wedged as it is between the two pairs of internal wedges. Therefore, it is largely the angle of the femurs 64 with respect to the ips which changes. Rotation of the sacrum 60 with respect to the hips is also experienced, as the user makes a slight adjustment in upright posture. The lordosis of the spine is still maintained, although some flattening (not shown in the drawing) is experienced when the suer is in the temporary position shown in FIG. 5.

Figure 6:
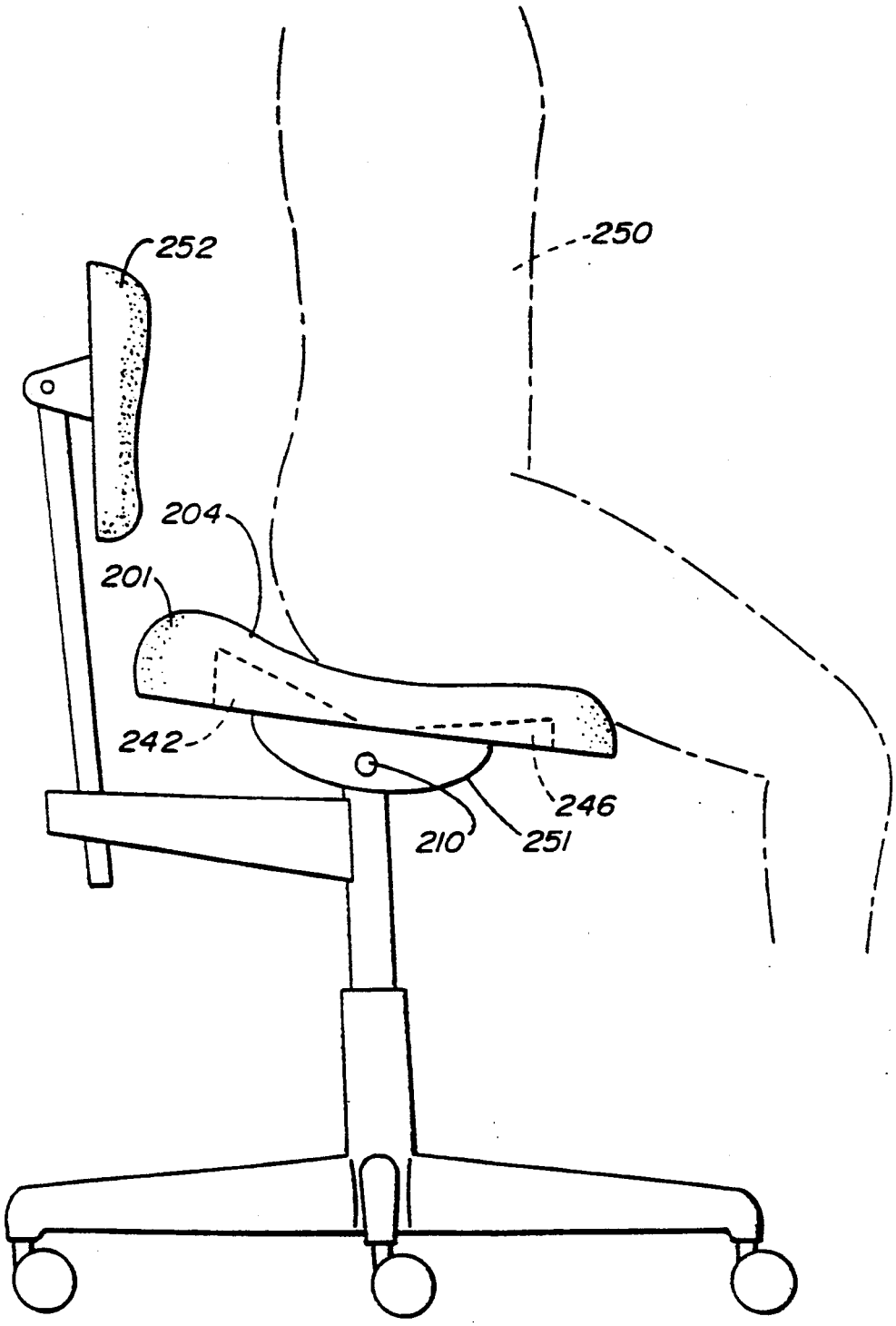
FIG. 6 is a diagrammatic side elevation of the cushion of this invention as incorporated into a chair.

Turning to FIG. 6, there is therein illustrated another embodiment of this invention, namely a seat cushion 201 which is incorporated into a finished chair 52 so as to replace (rather than ride upon) the regular seat of the chair. It is to be recalled that the preferred cushion 1 is a separate item which is used by resting it on top of the pre-existing seat of a chair or bench.

Cushion 201 generally comprises an external low-density (soft) foam cushion 204 and internal high-density (hard) foam wedges on supporting base means. In FIG. 6, only the right rear 242 and right front 246 internal wedges are visible in phantom. The base means, preferably comprising a suitable rigid planar structure as in the other embodiments, is not separately illustrated. The semi-cylindrical rocker of the preferred embodiment may be replaced, when the cushion is built into a chair 252, by an axle 210 pivoting about brackets 251 on the chair and the cushion base. The user 250 may attain correct seating posture by wedging his or their pelvic area between the internal wedge pairs and tilting the cushion forward, in the manner of the other embodiments of the invention.

Figure 7:
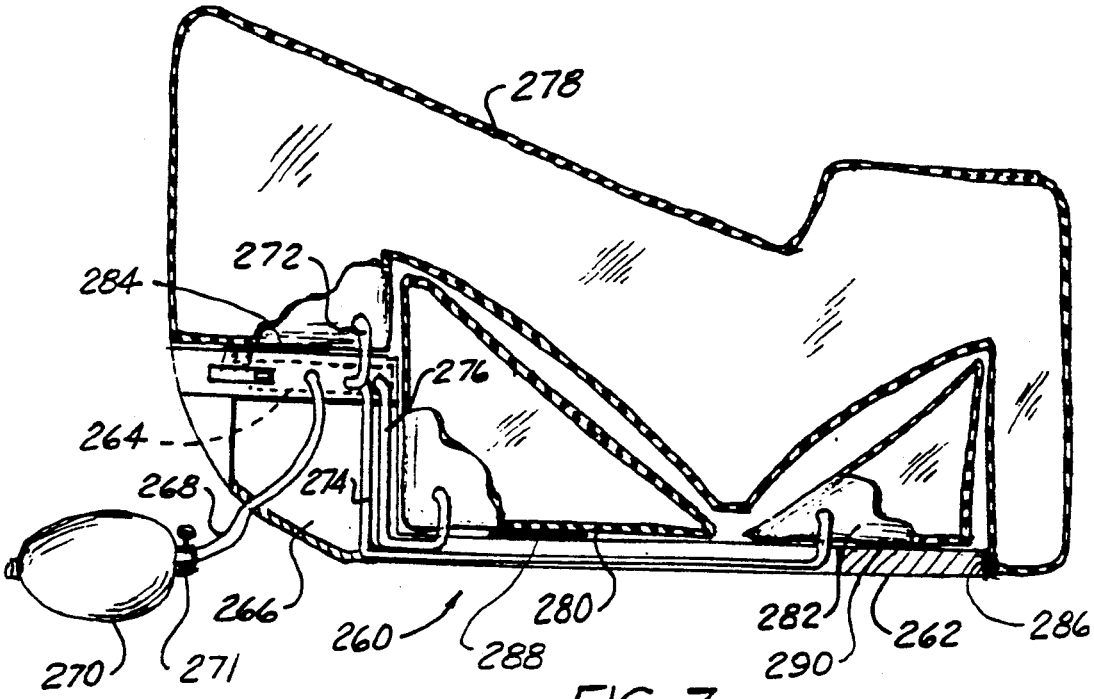
FIG. 7 is a partially broken cross-section similar to that of FIG. 2 except that inflexible fluid-containing bags are substituted for the foam-configured components of FIG. 2.

Turning now to FIG. 7 of the drawing, an alternative embodiment of the present invention is depicted at 260 and includes a rigid base 262, the rear portion of which is configured to provide a housing for a suitable slide valve means, suggested by the dashed lines 264, and a storage compartment 266. Extending from the valve is a supply tube 268 to which is attached a squeeze bulb 270 of conventional configuration. Also extending from valve 264 are three pressure lines 272, 274 and 276 which are connected to three inflatable containers 278, 280 and 282 respectively.

The containers 278–282 are made of a suitable airtight material. The external surfaces of containers are preferably covered with a suitable fabric for user comfort. Each unit consists of a single internally open container, a single container having one or more internal webs forming connected chambers, or may include a plurality of individual containers internconnected by suitable conduit means. Although the container 278, which corresponds to the external cushion 4 depicted in FIG. 1, is preferably a unitary element, it may be desirable to configure the containers 280 and 282 in the form of multiple elements corresponding to the rear wedges 40, 42 and 44, 46, respectively, as depicted in FIG. 1. In such case the containers would be either connected together by a suitable hose, or other conduit, or could alternatively be adapted for individual filling or pressurization. Container 278 is preferably attached to base 262 by means of VELCRO fasteners positioned at 284 and 286, with containers 280 and 282 being similarly attached to base 262 by VELCRO fasteners 288 and 290.

In the preferred embodiment, the valve 264 is a simple sliding spool valve movable between four positions, the first of which communicatively couples input line 268 to output line 272, the second being adapted to couple line 268 to line 274, and the third coupling line 268 to line 276. In the fourth position, no output line is connected to input line 268. It will thus be appreciated that, by setting the valve 264 in a particular position and squeezing bulb 270, air can be input to a particular container to inflate it to a selected hardness so as to effectively replicate the effect of the foam cushion and wedges illustrated above. Bulb 270 may also include a valve 271 for allowing air to be exhausted form any of the containers. After the containers are properly inflated, bulb 270 and line 268 may be stowed in the compartment 266.

Although the preferred embodiment includes an integral air supply source and is thus a self-contained unit, it will be appreciated that alternatively each container could have an individual needle-receiving valve of the type used in various type of air bladders such as in basketballs and volleyballs, etc., and an external pumping source and needle should be used to individually inflate each container. Furthermore, it will be appreciated that the several containers could also be filled with a suitable liquid such as water, oil or any other suitable filling gel or fluid. Operation and use of this embodiment would be substantially identical to that previously described.

While the above provides a full and complete disclosure of the preferred embodiments of this invention, various modifications, alternate constructions, and equivalents may be employed without departing from the true spirit and scope of the invention. Such changes might involve alternate materials. components, structureal arrangements, sizes, operational features or the like. For example the internal rear wedges might be able to be eliminated entirely, since it is the internal front wedges which prevent the pelvic area from tending to slide forward. Therefore, the above description and illustrations should not be construed as limiting the scope of the invention which is defined by the appended claims.

I claim:

1. A seat cushion including:

a base having upper and lower surfaces and having front and rear portions;

rocking means affixed to said base;

two internal rear wedges disposed on and affixed to the upper surface of the rear portion of the base and having a first upper face that slants downward toward the front portion of the base;

two internal front wedges disposed on and affixed to the upper surface of the front portion of the base and having a second upper face that slants downward toward the rear portion, one internal rear wedge and one internal front wedge being disposed on each side of a centerline that bisects the base into right and left portions; and an external cushion enveloping said front and rear wedges and said upper surface of said base, the top surfaces of first and second portions of said external cushion lying above said first and second upper faces being sloped downwardly toward each other from points above said front and rear base portions to form an elongated cavity for receiving the buttocks of a user.

2. The apparatus of claim 1 wherein:

said base is rigid, said internal wedges are made of high-density foamed polymer plastic, said external cushion is made of low-density foamed polymer plastic, and said rocking means is a semi-cylindrical segment of a tube which is mounted perpendicular to the centerline of said base.

3. The apparatus of claim 2 further including:

a first recess in the top surface of said first portion; and a second recessing the top surface of said second portion.

4. The apparatus of claim 3 wherein:

each of the two internal rear wedges and each of the two internal front wedges is offset from the other, forming two gaps along the centerline of the base.

5. The apparatus of claim 4 further including:

hook and loop fastener material securing said internal wedges onto the upper surface of said base.

6. The apparatus of claim 5 further including:

hook and loop fastener material securing the semi-cylindrical tube segment onto the lower surface of said base.

7. The apparatus of claim 1 wherein said front and rear wedges are made of a resilient material having a first density, and said external cushion is made of a resilient material having a second density substantially lower than said first density.

8. The apparatus of claim 1 wherein said front and rear wedges are formed by inflatable containers.

9. The apparatus of claim 1 wherein said external cushion is formed by an inflatable container.

10. In a chair, the improvement comprising a seat cushion including:

a base having upper and lower surfaces and having front and rear portions;

two internal high-density foam rear wedges disposed on and affixed to the upper surface of the rear portion of said base, said rear wedge having a first upper face that slants downward toward said front portion;

two internal high-density foam front wedges disposed on and affixed to the upper surface of the front portion of said base, said front wedge having a second upper face that slants downward toward said rear portion, one internal rear wedge and one internal front wedge being disposed on each side of a centerline that bisects the base into right and left portions;

an external low-density foam cushion enveloping said internal wedges and affixed to said base, the surface of said cushion having a portion generally conforming to the upper surfaces of said wedges and forming a transversely extending recess for receiving the buttocks of a user; and pivot means for rockably attaching the base of the seat cushion to the chair.

11. The apparatus of claim 10 further including:

a third upper face on said external cushion that slants downward toward the front portion of said base and terminates in an upwardly protruding lip.

12. The apparatus of claim 11 wherein:

said pivot means is an axle that pivots about brackets mounted on the chair and the base.

13. The apparatus of claim 12 further including;

a first recess formed in said third upper face, and a second recess formed in said lip.

* * * * *